US007024808B2

(12) United States Patent
Chiang

(10) Patent No.: US 7,024,808 B2
(45) Date of Patent: Apr. 11, 2006

(54) NEON SIGN ARRANGEMENT

(76) Inventor: David Chiang, 1965 Plaza Rd., Oceanside, CA (US) 92056

( * ) Notice: Subject to any disclaimer, the term of this patent is extended or adjusted under 35 U.S.C. 154(b) by 0 days.

(21) Appl. No.: 10/884,755

(22) Filed: Jul. 2, 2004

(65) Prior Publication Data

US 2006/0000129 A1 Jan. 5, 2006

(51) Int. Cl.
*G09F 13/26* (2006.01)

(52) U.S. Cl. ..... 40/545; 40/550; 40/572

(58) Field of Classification Search ..... 40/545, 40/550, 552, 572

See application file for complete search history.

(56) References Cited

U.S. PATENT DOCUMENTS 1,825,799 A * 10/1931 Hotchner ..... 40/545
1,918,615 A * 7/1933 Scott ..... 40/545
2,157,185 A * 5/1939 Nickel ..... 40/545
2,186,982 A * 1/1940 Mansell ..... 40/545

* cited by examiner

*Primary Examiner*—Cassandra Davis
(74) *Attorney, Agent, or Firm*—Raymond Y. Chan; David & Raymond

(57) ABSTRACT

A neon sign arrangement includes a supporting frame, a displaying cover, and a neon light unit. The supporting frame has a first displaying side and an opposed second displaying side. The displaying cover has a displaying character mounted on the first displaying side. The neon light unit includes a neon light tube which has a character sign portion and is supported by the supporting frame, and a power controller which is electrically connected to the neon light tube such that when it is powered up, it forms as a light source to highlight the displaying cover as well as generate a neon light effect at the second displaying side.

19 Claims, 4 Drawing Sheets

NEON SIGN ARRANGEMENT

BACKGROUND OF THE PRESENT INVENTION

1. Field of Invention

The present invention relates to neon light, and more particularly to a neon sign arrangement wherein a single neon light source is utilized to form a neon sign and well as a light source for a light box in one integral unit.

2. Description of Related Arts

Conventional neon lights and advertisement signs are widely utilized to attract customers and to perform certain business functions, such as indication of opening hours or promotion of certain brands.

Generally speaking, neon lights are well-known as providing a rather stable, reliable, and a wide variety source of high-intensity lighting. For example, within one particular neon sign, it may consist of several colors arranged in a particular manner for building up an exceptionally sharp and impressive advertisement pattern.

Instead of using neon signs, some people prefer light boxes. It offers the flexibility that the light box cover is generally replaceable. Therefore, while a particular neon sign provides that only sign whatsoever, the advertisement pattern on a light box may be changed and replaced regularly so as to cope with changing business environment. For example, a particular advertisement pattern may only be suitable for a particular promotion campaign, such that when that campaign ends, another advertisement pattern may be replaced for use in other purposes.

There are however, disadvantages for these traditional illumination devices. First, neon signs and light boxes of noticeable size are usually bulky. Apart from the actual neon light tubes which illuminate high intensity light, a neon light usually further comprises a bulky supporting base and a power transformer. When two or more neon signs are required in a particular shop, they would definitely take up a considerable amount of worthy business space. Indeed, as a matter of fact, in many occasions, even a small business, such as a small grocery shop, requires more than one advertising sign. Therefore, the shop owner has to allocate a considerable amount of space for each particular neon sign or advertisement light box.

Second, the more the illumination devices, the greater the heat they generate. It has been well-known that neon lights generate a substantial amount of heat while operating. When a shop using several neon signs at a time, there exist potential risk to customers and employees alike because of that high temperature surrounding the sign. Light boxes are better than neon signs, but their temperature can never be underestimated.

Third, obviously, the more the illumination devices, and more consumption of electricity and this inevitably increase the cost of running the business and maintenance. In light of all these, a more efficient and convenient illumination device is required.

SUMMARY OF THE PRESENT INVENTION

A main object of the present invention is to provide a neon sign arrangement wherein a single neon light source is utilized to form a neon light sign as well as a light source for a light box in one integral unit.

Another object of the present invention is to provide a neon sign arrangement which is capable of providing simultaneous illumination in a front and a rear side thereof. In other words, only one single light source is utilized to provide two opposed displaying views.

Another object of the present invention is to provide a neon sign arrangement which has the effect of minimizing operating cost, temperature, as well as occupying size of conventional illumination devices with comparable displaying effects i.e. dual displays in opposite directions.

Another object of the present invention is to provide a neon sign arrangement which does not alter operation structure and design of conventional neon light so as to minimize the manufacturing cost of the present invention.

Accordingly, in order to accomplish the above objects, the present invention provides a neon light arrangement, comprising:

a supporting frame having a first displaying side and an opposed second displaying side;

a displaying cover, having a displaying character, mounted on the first displaying side of the supporting frame; and a neon light unit, which comprises:

at least a neon light tube, having a character sign portion, supported by the supporting frame; and a power controller supported by the supporting frame and electrically connected with the neon light tube such that when the neon light tube is powered up, the neon light tube forms as a light source to highlight the displaying cover at the first displaying side of the supporting frame and generates a neon light effect of the character sign portion as a neon light sign at the second displaying side of the supporting frame.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
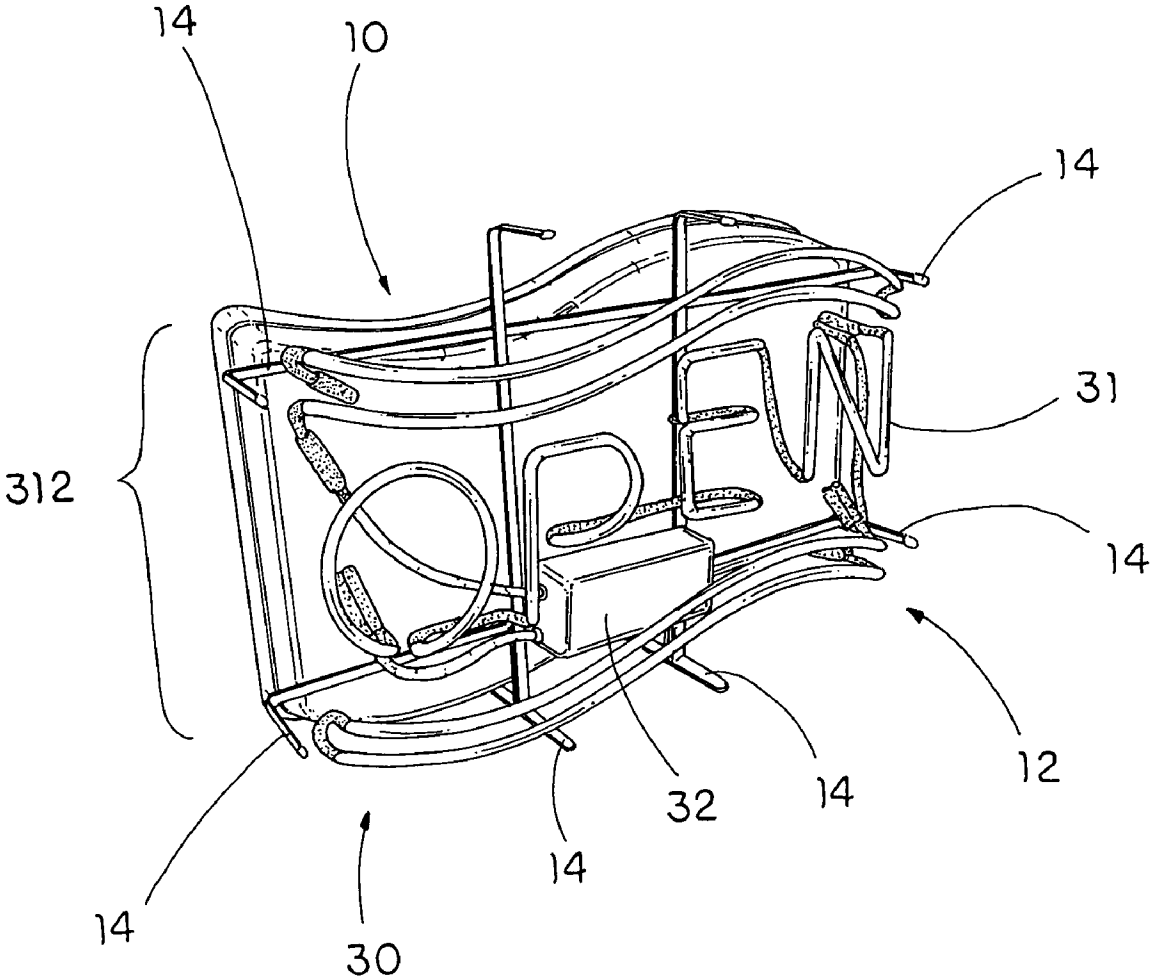
FIG. 1A and FIG. 1B are perspective views of the neon sign arrangement to a first preferred embodiment of the present invention, illustrating a front and a rear side of the neon sign arrangement respectively.
Figure 1B:
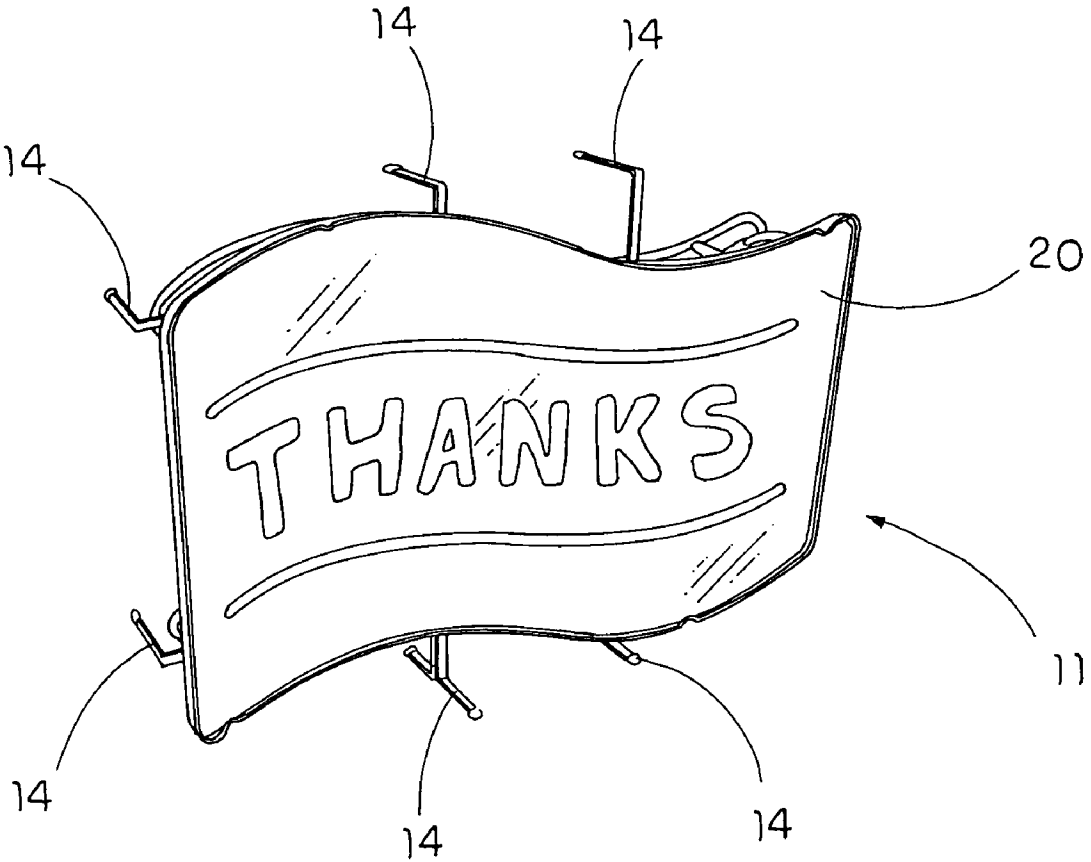

Referring to FIG. 1A and FIG. 1B of the drawings, a neon sign arrangement according to a preferred embodiment of the present invention is illustrated, in which the neon sign arrangement comprises a supporting frame 10, a displaying cover 20, and a neon light unit 30. The neon sign arrangement may be utilized, for example, in usual commercial location, such as a shop, for dual displays of a neon sign as well as a particular advertisement or business sign.

The supporting frame 10 has a first displaying side 11 and an opposed second displaying side 12 for displaying particular business signs or advertisements. The displaying cover 20 has a displaying character mounted on the first displaying side 11 of the supporting frame 10.

The neon light unit 30 comprises at least a neon light tube 31, which has a character sign portion, supported by the supporting frame 10, and a power controller 32 supported by the supporting frame 10 and electrically connected with the neon light tube 31 such that when the neon light tube 31 is powered up, the neon light tube 31 forms as a light source to generate light to highlight the displaying cover at the first displaying side 11 of the supporting frame 10, and generates a neon light effect of the character sign portion as a neon light sign at the second displaying side 12 of the supporting frame 10.

2. The neon sign arrangement, as recited in claim 1, wherein said neon light tube further has a light source portion extended along said first displaying side of said supporting frame while said character sign portion of said neon light tube is extended along said second displaying side of said supporting frame, such that when said neon light tube is powered up by said power controller, said character sign portion of said neon light tube generates said neon light effect at said second displaying side of said supporting frame while said light source portion of neon light tube highlights said displaying cover at said first displaying side of said supporting frame respectively Referring to FIG. 1A, FIG. 1B and FIG. 2 of the drawings, the neon light tube 31 is securely supported on the second displaying side 12 of the supporting frame 10 wherein the character sign portion is embodied as a predetermined character sign, such as an 'O', and extended on the second displaying side 12 such that when it is lit up, it forms the neon light effect from that character sign portion of the neon light tube 31. According to the preferred embodiment, the supporting frame 10 further comprises a plurality of supporting arms 15 outwardly extended therefrom to securely mount the neon sign portion 312 of the neon light tube 31 on the second displaying side 12 so as to spacedly and suspendedly support the neon sign portion 312 thereon in position.

The neon light tube 31, trapped with neon gas therein, is adapted to generate high-intensity neon light beam as a line of light source so as to highlight the character sign formed by the character sign portion when the neon gas is energized by high potential difference. Neon light tubes 31 of differing colors can be chosen for providing different neon lighting effects. Obviously, the character sign portion may be embodied as forming more than one character sign, such as an 'OPEN' sign as shown in FIG. 1A of the drawings.

The neon light tube 31 further has a light source portion 311 extended along the first displaying side 11 of the supporting frame 10, and a connecting portion extending between the light source portion 311 and the neon sign portion 312 by penetrating through the supporting frame 10. The connecting portion is electrically connected with the power controller 32 in such a manner that when the power controller 32 is activated, it synchronically provides high voltage to the connecting portion to energize neon gas inside the light source portion 311 and the character sign portion for producing high intensity illumination.

Accordingly, the supporting frame 10 has at least a through slot 16 formed thereon to communicate the first displaying side 11 with the second displaying side 12, wherein the light source portion 311 of the neon light tube 31 is extended from the character sign portion 312 thereof through the through slot 16 such that the light source portion 311 and the character sign portion 312 of the neon light tube 31 are respectively supported at the first and second displaying side 11, 12 of said supporting frame 10. Note that the connecting portion of the neon light tube 31 is preferably made of flexible yet durable materials such as plastic materials so that connection between the light source portion 311 and the neon sign portion 312 can be substantially achieved.

Figure 2:
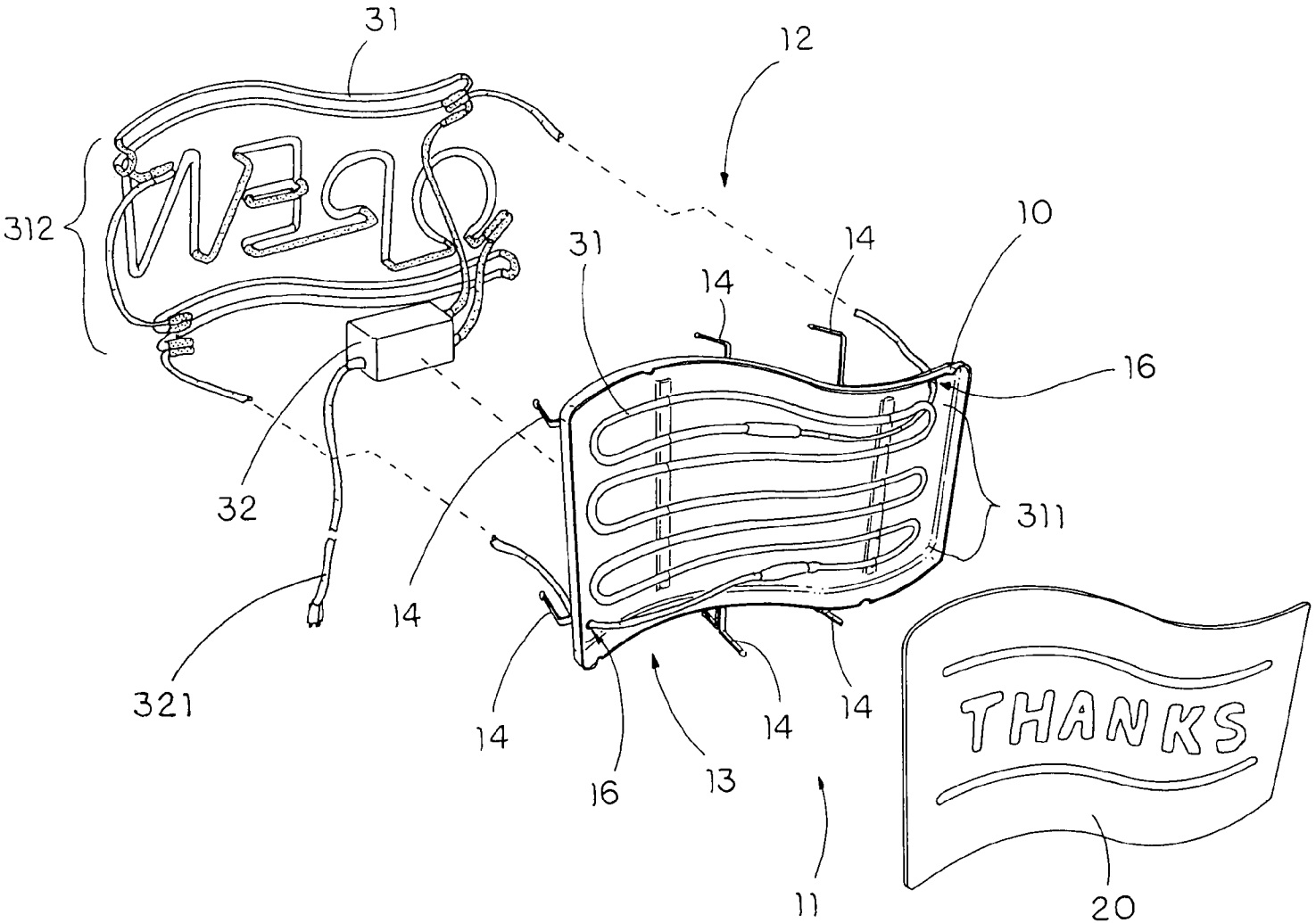
FIG. 2 is an exploded perspective view of the neon sign arrangement according to the above preferred embodiment of the present invention.

Specifically, referring to FIG. 2 of the drawings, the light housing 13 defines a light compartment 131 and is protrudedly formed on the first displaying side 11 along a side rim thereof wherein the light source portion 311 of the neon light tube 31 is securely received in the light compartment 131. In other words, the displaying cover 20 is mounted to the first displaying side 11 of the supporting frame 10 so as to fittedly enclose the light compartment 131 such that light generated by the light source portion 311 of the neon light tube 31 is allowed to reach the displaying cover 20.

The displaying cover 20 has a predetermined displaying pattern formed thereon (such as the 'Thanks' as shown in FIG. 1B of the drawings), and is embodied as having a predetermined light transmisivity such that when high-intensity light from the light source portion 311 reaches the displaying cover 20, it is arranged to pass through there and highlight the displaying pattern on the displaying cover 20. According to the preferred embodiment, the light source portion 311 is elongated in length and colied in the light compartment 131 in a zigzag manner and evenly distributed on the first displaying side 11 of the supporting frame 10 so that the displaying cover 20 can be uniformly and sharply highlighted and shown.

Furthermore, the displaying cover 20 is preferably mounted on the light housing 13 in a detachably replaceable manner so that as time goes by, a user of the present invention may freely choose to dispose the existing displaying cover 20 and replace with a most suitable one with respect to, say, a particular promotion campaign, in order to achieve maximum business opportunity. Alternatively, the user may actually design by his own a completely new displaying cover 20 to fit with the light housing 13. Thus, one may appreciate the great flexibility of the present invention.

In order to enhance the reflection performance inside the light housing 13, the light housing 13 may further has a reflective layer coated in inner walls thereof for enhancing a reflection pattern inside the light housing 13 and as a result achieving a more coherent and intensive highlight of the displaying cover 20. The reflective layer is preferably embodied, to its simplest form, as a sliver coating, so that the displaying cover 20 could be optimally highlighted.

The power controller 32 is mounted on the second displaying side 12 in between the protruded neon light tube 31 and the supporting frame 10. Moreover, it is electrically connected between the neon light tube 31 and external power source so as to acquire electricity to light up the neon light tube 31. The power controller 32 comprises an operation switch 321 which is embodied as a switching string extended from the power controller 32 and adapted to be slightly pulled for sequentially turning on and off the neon light tube 31 on both the first displaying side 11 and the second displaying side 12.

Figure 3:
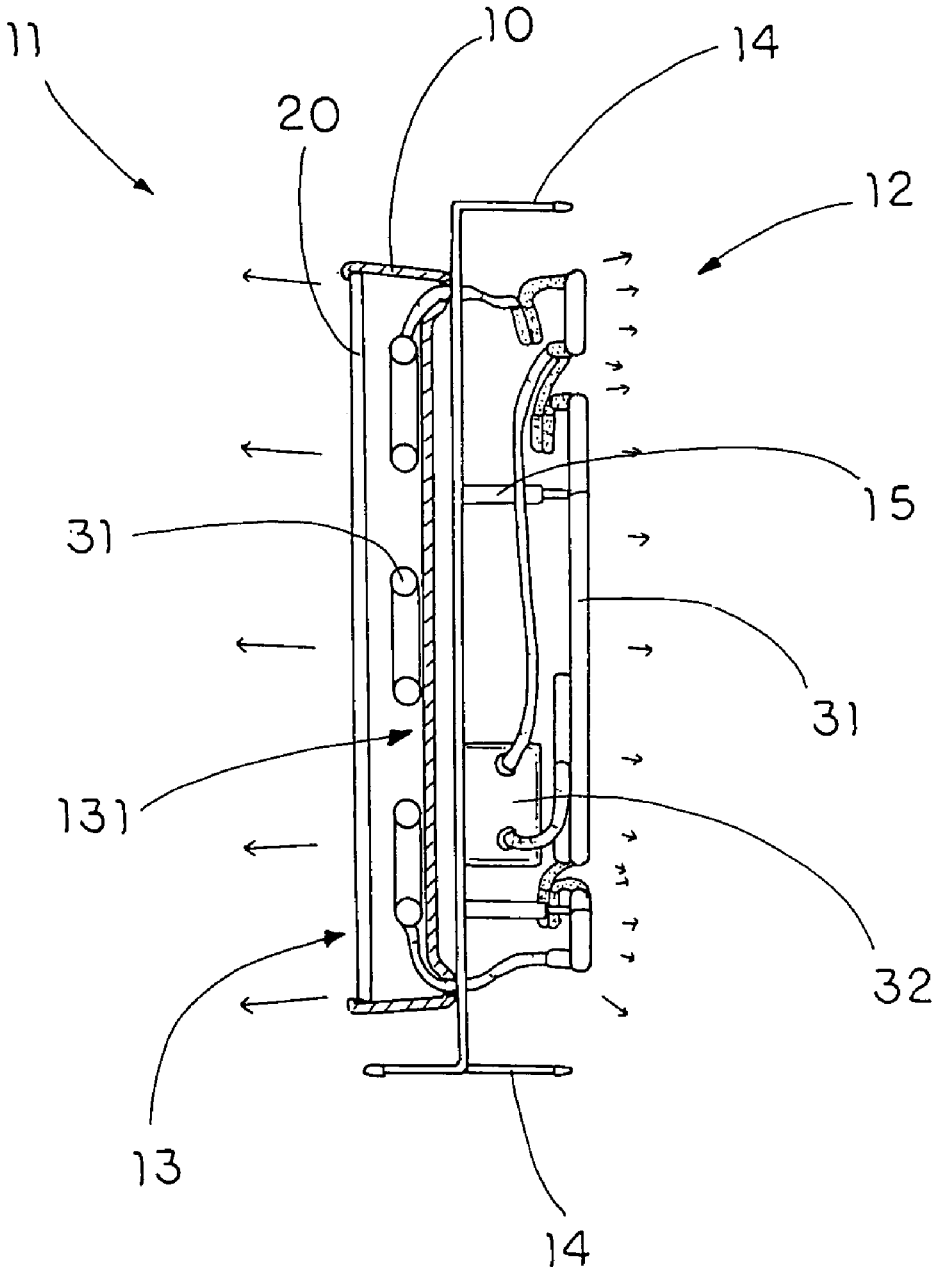
FIG. 3 is a side view of the neon sign arrangement according to the above preferred embodiment of the present invention.

It is worth mentioning that since the power controller 32 is mounted in between the supporting frame 10 and the neon light tube 31, the overall thickness of the present invention will not significantly greater than a mere combination of a conventional neon sign and a conventional light box. Referring to FIG. 3 of the drawings, the light source portion 311 of the neon light tube 31 is substantially received in the light housing 13 which is similar in thickness with respect to the supporting frame of a conventional neon light sign, in other words, the present invention provides dual displays, i.e. neon sign and the highlighted displaying cover 20, with minimum overall thickness. Thus, instead of using separate neon sign and a light box displaying different subject matters, the present invention utilizes a compact single unit to fulfill both functions without increasing the overall size of any one of the two constituent, i.e. the neon sign or the light box. Moreover, the present invention utilizes a single switch for controlling the operation of both the constituents.

In order to further enhance the utility of the present invention, the supporting frame 10 further comprises a plurality of standing legs 14 outwardly and integrally extended therefrom such that the neon sign arrangement may stand by itself as a self-supported single unit in different orientations. Moreover, the exterior shape of the supporting frame 10 may be varied in accordance with market demands and that any shapes so manufactured should fall squarely within the scope of protection of the present invention.

Thus, the displaying cover 20 may be embodied as a wide variety of shapes so as to fit different marketing needs. Since the supporting frame 10 may stand in different orientation, as a result, the maximum combination of neon sign and the advertisement pattern in the displaying cover 20 can be obtained.

It is of course also important to mention that the scope of the present invention does not stop at the mode of illumination. That is to say, any other forms of illumination may be employed, such as LEDs illumination or fluorescent lamps. In such a case, the other forms of illuminations are also able to provide two sided displays.

The application of the present invention is elaborated as follows: a user of the neon sign arrangement may be able to erect the sign by a display window showing 'OPEN' from the front. The displaying cover 20 may be fabricated as 'THANKS' so that when a customer finished purchasing, eating or doing business, he may be noticed by the displaying cover 'THANKS'. Since the displaying cover 20 is replaceable from the light housing 13, the user may be able to adopt the most up-to-date advertisement patterns or business slogans from time to time.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A neon sign arrangement comprising:

a supporting frame having a first displaying side and an opposed second displaying side;

a displaying cover, having a displaying character and a predetermined light transitivity, mounted on said first displaying side of said supporting frame, and a neon light unit which comprises:

at least a neon light tube, having a character sign portion shaped into predetermined one or more characters, supported by said supporting frame; and a power controller supported by said supporting frame and electrically connected with said neon light tube such that when said neon light tube is powered up, said neon light tube forms as a light source to generate light to highlight said displaying cover at said first displaying side of said supporting frame and generates a neon light effect of said character sign portion as a neon light sign at said second displaying side of said supporting frame, wherein said neon light tube further has a light source portion extended along said first displaying side of said supporting frame while said character sign portion of said neon light tube is extended along said second displaying side of said supporting frame, such that when said neon light tube is powered up by said power controller, said character sign portion of said neon light tube generates said neon light effect at said second displaying side of said supporting frame while said light source portion of neon light tube highlights said displaying cover at said first displaying side of said supporting frame respectively.

2. The neon sign arrangement, as recited in claim 1, wherein said supporting frame has at least a through slot formed thereon to communicate said first displaying side with said second displaying side, wherein said light source portion of said neon light tube is extended from said character sign portion thereof through said through slot such that said light source portion and said character sign portion of said neon light tube are respectively supported at said first and second displaying side of said supporting frame.

3. The neon sign arrangement, as recited in claim 2, wherein said neon light tube further has a connecting portion electrically extending from said light source portion to said neon sign portion through said through slot of said supporting frame, wherein said connecting portion is electrically connected said character sign portion with said light source portion such that when said power controller is activated, said character sign portion and said light source portion of said neon light tube are powered up synchronically to generate said light at said second and first displaying sides of said supporting frame respectively.

4. The neon sign arrangement, as recited in claim 1, wherein said supporting frame comprises a light housing defining a light compartment to receive said light source portion of said neon light tube therein such that said displaying cover is mounted at said first displaying side of said light housing to enclose said light compartment thereof.

5. The neon sign arrangement, as recited in claim 4, wherein said light source portion of said neon light tube is coiled in said light compartment in a zigzag manner to evenly distribute said light within said light compartment towards said displaying cover.

6. The neon sign arrangement, as recited in claim 4, wherein said displaying cover is detachably mounted within a surrounding rim of an opening of said light compartment to enclose said light source portion of said neon light tube within said light compartment, such that said displaying cover is adapted to be replaced with another said displaying cover at said first displaying side of said supporting frame.

7. The neon arrangement, as recited in claim 4, wherein said supporting frame further comprises a plurality of supporting arms spacedly extended from said light housing at said second displaying side to spacedly support said character sign portion of said neon light tube from said light housing in a suspended manner.

8. The neon sign arrangement, as recited in claim 4, wherein said light housing further has a reflective layer coated in an inner wall thereof to reflect said light from said light source portion of said neon light tube towards said displaying cover so as to enhance a light intensity within said light compartment to highlight said displaying cover.

9. The neon sign arrangement, as recited in claim 3, wherein said supporting frame comprises a light housing defining a light compartment to receive said light source portion of said neon light tube therein such that said displaying cover is mounted at said first displaying side of said light housing to enclose said light compartment thereof.

10. The neon sign arrangement, as recited in claim 9, wherein said light source portion of said neon light tube is coiled in said light compartment in a zigzag manner to evenly distribute said light within said light compartment towards said displaying cover.

11. The neon sign arrangement, as recited in claim 10, wherein said displaying cover is detachably mounted within a surrounding rim of an opening of said light compartment to enclose said light source portion of said neon light tube within said light compartment, such that said displaying cover is adapted to be replaced with another said displaying cover at said first displaying side of said supporting frame.

12. The neon arrangement, as recited in claim 11, wherein said supporting frame further comprises a plurality of supporting arms spacedly extended from said light housing at said second displaying side to spacedly support said character sign portion of said neon light tube from said light housing in a suspended manner.

13. The neon sign arrangement, as recited in claim 10, wherein said power controller is securely mounted at said second displaying side of said supporting frame to control said character sign portion and said light source portion of said neon light tube, so as to minimize an overall thickness of said light housing to retain said light source portion of said neon light tube therein.

14. The neon sign arrangement, as recited in claim 9, wherein said displaying cover is detachably mounted within a surrounding rim of an opening of said light compartment to enclose said light source portion of said neon light tube within said light compartment, such that said displaying cover is adapted to be replaced with another said displaying cover at said first displaying side of said supporting frame.

15. The neon sign arrangement, as recited in claim 14, wherein said power controller is securely mounted at said second displaying side of said supporting frame to control said character sign portion and said light source portion of said neon light tube, so as to minimize an overall thickness of said light housing to retain said light source portion of said neon light tube therein.

16. The neon arrangement, as recited in claim 15, wherein said supporting frame further comprises a plurality of supporting arms spacedly extended from said light housing at said second displaying side to spacedly support said character sign portion of said neon light tube from said light housing in a suspended manner.

17. The neon sign arrangement, as recited in claim 16, wherein said light housing further has a reflective layer coated in an inner wall thereof to reflect said light from said light source portion of said neon light tube towards said displaying cover so as to enhance a light intensity within said light compartment to highlight said displaying cover.

18. The neon sign arrangement, as recited in claim 15, wherein said light housing further has a reflective layer coated in an inner wall thereof to reflect said light from said light source portion of said neon light tube towards said displaying cover so as to enhance a light intensity within said light compartment to highlight said displaying cover.

19. The neon sign arrangement, as recited in claim 9, wherein said power controller is securely mounted at said second displaying side of said supporting frame to control said character sign portion and said light source portion of said neon light tube, so as to minimize an overall thickness of said light housing to retain said light source portion of said neon light tube therein.

* * * * *